US008444335B2

(12) United States Patent
Faridoon

(10) Patent No.: US 8,444,335 B2
(45) Date of Patent: May 21, 2013

(54) MULTI-COLOR PEN

(76) Inventor: Husain S. A. Faridoon, House Area (KW)

( * ) Notice: Subject to any disclaimer, the term of this patent is extended or adjusted under 35 U.S.C. 154(b) by 299 days.

(21) Appl. No.: 12/605,643

(22) Filed: Oct. 26, 2009

(65) Prior Publication Data

US 2010/0111588 A1 May 6, 2010

Related U.S. Application Data

(60) Provisional application No. 61/111,433, filed on Nov. 5, 2008.

(51) Int. Cl.
*B43K 27/04* (2006.01)

(52) U.S. Cl.
USPC ..... 401/34; 401/17; 401/18; 401/195

(58) Field of Classification Search
USPC ..... 401/195, 52, 16, 17, 18, 20, 23, 34, 401/29
See application file for complete search history.

(56) References Cited

U.S. PATENT DOCUMENTS

| | | | | | |
|---|---|---|---|---|---|
| 1,200,238 | A | * | 10/1916 | Reith | 401/195 |
| 1,354,195 | A | * | 9/1920 | Jokubaitis | 33/355 R |
| 1,598,427 | A | * | 8/1926 | Easton | 30/123 |
| 1,806,849 | A | * | 5/1931 | Gelardi | 33/485 |
| 1,875,184 | A | * | 8/1932 | Steigleder | 401/186 |
| D114,899 | S | * | 5/1939 | Lipic | D10/53 |
| 2,615,648 | A | * | 10/1952 | Carlson | 242/384.7 |
| 2,841,156 | A | * | 7/1958 | Herald | 132/73.5 |
| 5,957,601 | A | * | 9/1999 | Weiss | 401/18 |
| D497,388 | S | * | 10/2004 | Kit | D19/36 |
| 6,814,226 | B2 | * | 11/2004 | Chao | 206/5 |

* cited by examiner

*Primary Examiner* — David Walczak
(74) *Attorney, Agent, or Firm* — Lowe Hauptman Ham & Berner, LLP

(57) ABSTRACT

A multi-color pen includes a multi-segmented pen body including a longitudinally extending cylindrical hollow tube having a longitudinal axis and a plurality of cylindrical sub-assemblies each of which includes a supply of writing material and a writing point connected to one of the supplies of writing materials. An eraser is disposed at an end of a hollow tube and is shown with a removable cover. The cover may include a compass or a digital thermometer in place of the digital clock. In addition, a rotatable pocket clip extends from the top of the cover and includes a ruler having a straight edge and graduations of length as well as a knife blade or letter opener that is rotatably separable with respect to the ruler.

1 Claim, 6 Drawing Sheets

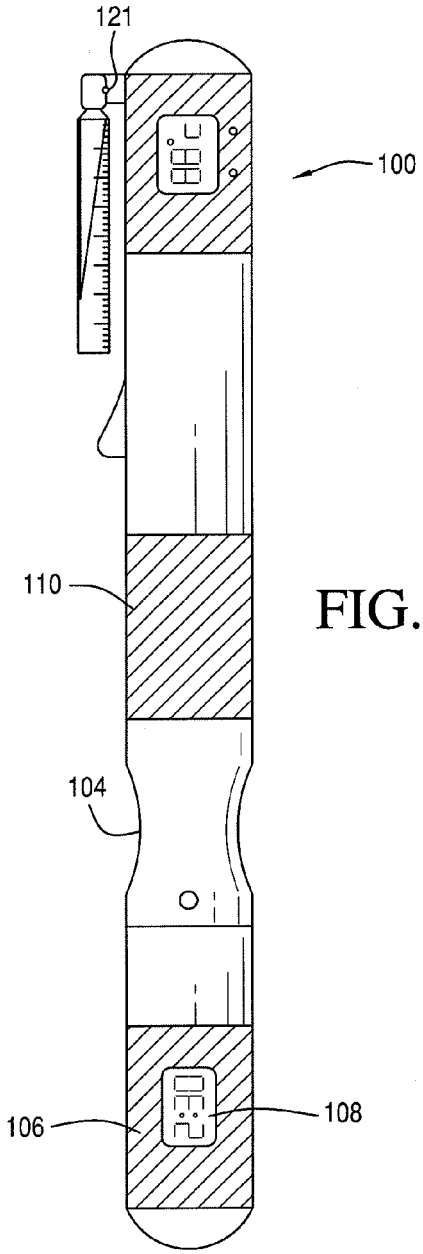
FIG. 3
FIG. 4
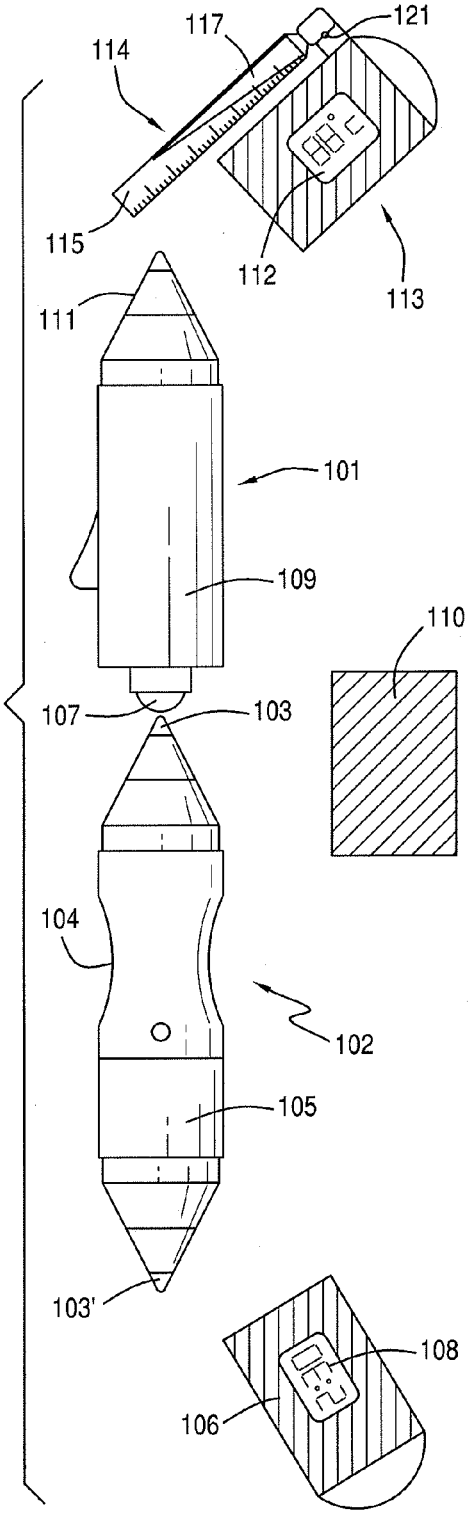

MULTI-COLOR PEN

CROSS-REFERENCE TO RELATED APPLICATIONS

This application claims the benefit of the filing date of U.S. Provisional Application Ser. No. 61/111,433, filed Nov. 5, 2008, entitled "Multi-Color Pen".

FIELD OF THE INVENTION

This invention relates to a multi-color pen and more particularly to a multi-color pen with a plurality of useful implements.

BACKGROUND OF THE INVENTION

Multi-color pens are well known and have been in wide spread use for many years. For example, a U.S. Pat. No. 4,692,046 of Lan discloses a pen containing multi-color cores located in different tubes housed in the pen body. The colors can be optionally selected for use readily using a specially designed turnable knob having a projected edge in cam contact with the top end of the core-receiving tubes. The top end of the core-receiving tube is pushed down-ward for use, when the turnable knob is rotated to enable a person to select a color core quickly and readily.

A more recent development in multi-color pens with storage functions is disclosed in a U.S. Pat. No. 7,347,638 of Lin. As disclosed, the pen with storage function includes a pen holder, an end of which includes a storage device, enabling a USB (Universal Serial Bus) connector of the storage device to protrude out of the penholder, for connecting with an external computer to download data. A chosen place on a surface of the penholder is installed with a light pervious casing, and an inner wall of the penholder, corresponding to the light pervious casing, is surrounded with at least one solar power flashing LCD (Liquid Crystal Display), such that when the LCD has absorbed sufficient solar energy, commercial prints on the LCD can be flashingly displayed.

Notwithstanding the above, it is presently believed that there is a need and a potential commercial market for a multi-color pen that includes a plurality of useful implements. There should be a market for such devices because they can provide multiple elements in a convenient and relatively small space and enable a user to use the pen for various purposes.

BRIEF SUMMARY OF THE INVENTION

In essence a multi-color pen in accordance with the present invention includes a plurality of useful implements. For example, the pen comprises a multi-segmented pen body including a longitudinally extending hollow tube having a longitudinal axis, an outer wall, a tapered lower portion, an open upper end and an open lower end. A plurality of cylindrical sub-assemblies, each of which includes a supply of writing material and a writing point connected to one of the supplies of writing material. In one embodiment of the invention an eraser is disposed in and closes said opening in the upper end. In addition, means are provided for extending one of the writing points out of the open lower end for engagement with a writing surface and for retracting the writing point into the hollow tube and subsequently retracting the point into the hollow tube. A cylindrical longitudinally extending cover having a longitudinal axis with a closed top and an open bottom end for sealingly closing the writing points within the body of the pen is provided. A compass is disposed on the top of the upper end of the cover while a digital time and temperature indicator are disposed on a side of the cover. In addition, a rotatable pocket clip extends downwardly from the top of the cover along the longitudinal axis of the cover and is rotatable about an axis that is perpendicular to the axis of the longitudinal cover. The pocket clip includes a ruler having a straight edge and graduations of length along the edge as well as a letter opener with a sharp edge that is separate from the ruler but rotatable therewith and there apart for use as a letter opener.

A second embodiment of the invention includes a longitudinally extending pen body including two separable hollow tubes each with opposite ends and wherein the hollow tubes are aligned along a common axis. A first writing element with a first selected color is disposed in and extending out of one end of the first of the two separable hollow tubes while a second and a third writing element are disposed in opposite ends of the second of the two separable hollow tubes and wherein each of the second and third writing elements are of different colors that are different than the color of the first writing element. Further, a hollow connecting member connects the separable hollow tubes together along the common axis to form the pen body having a first portion and a generally common diameter. A first pen cover having an open end and a closed end is constructed and dimensioned to cover and seal the first writing element and includes a rotatable pocket clip extending downwardly along a first portion of the pen body and rotatable at one end thereof about an axis that is perpendicular to the common axis.

In the second embodiment of the invention, the rotatable pocket clip includes a ruler having a straight edge and graduations of length along the straight edge and a letter opener with a sharp edge separate from the straight edge but rotatable about the same axis as the ruler. A compass is disposed in the closed end of the first cover and a digital readout for a thermometer or time piece is disposed in a side of the first cover. A second pen cover having an open end and a closed end constructed and dimensioned to cover and seal one of the second or third writing elements is provided and a digital readout for the other of a temperature or time is disposed in the second cover.

The invention will now be described in connection with the accompanying figures wherein like reference numerals have been used to indicate like parts.

DESCRIPTION OF THE DRAWINGS

FIG. 3 is a side elevational view of a multi-color pen in accordance with a second embodiment of the invention;

FIG. 4 is an exploding view of the multi-color pen shown in FIG. 3;

DESCRIPTION OF THE PREFERRED EMBODIMENTS OF THE INVENTION

Figure 1:
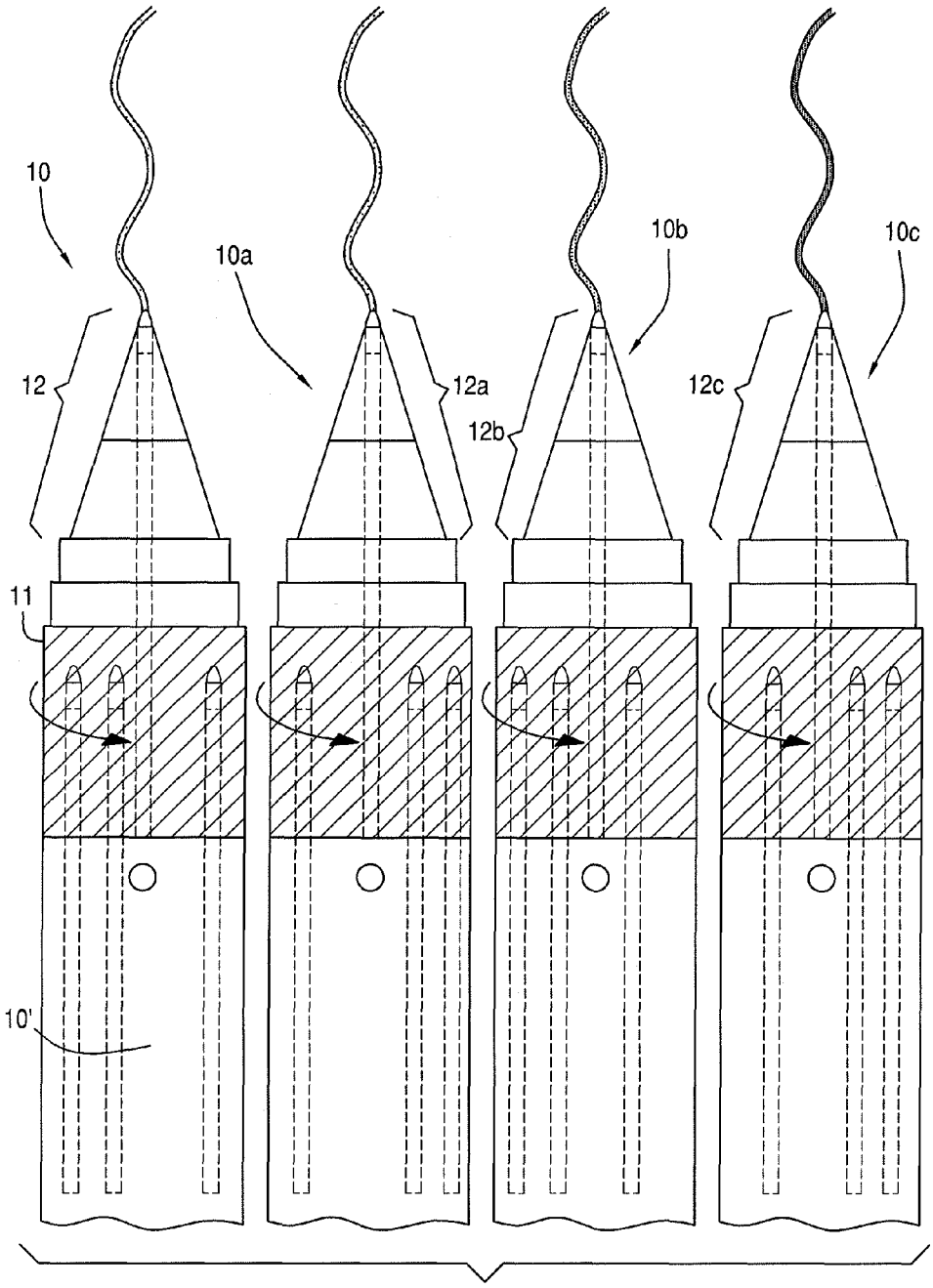
FIG. 1 is a schematic illustration of four multi-color pens in accordance with the present invention wherein different colors are extended for writing.

A pen 10 in accordance with a preferred embodiment of the invention comprises a pen body including a hollow tube 10' having a longitudinally extending axis as illustrated in FIG. 1 wherein four side elevational views of a forward portion of the pen 10 are provided to illustrate the application with four colors of ink. For example the pen 10 on the far left side of the figure is adapted to write with blue ink, has a 3 cm tip 12, weighs about 1.5 grams and produces a script with a thickness of about 0.01 cm. thick. The second pen to the left, 10*a*, is used for red colors and has the same characteristics as the pen 10 that is a 3 cm tip 12*a* that weighs about 1.5 grams and produces a script with a thickness of about 0.01 cm. thick. The pen identified in FIG. 1 has a tip 12*b* with similar characteristics as 10 and 10*a* (FIG. 1), but is used to write with black ink while the pen identified as 10*c* has a tip 12*c* that is generally similar to 10, 10*a* and 10*b*, but is adapted to write with green ink.

Figure 2:
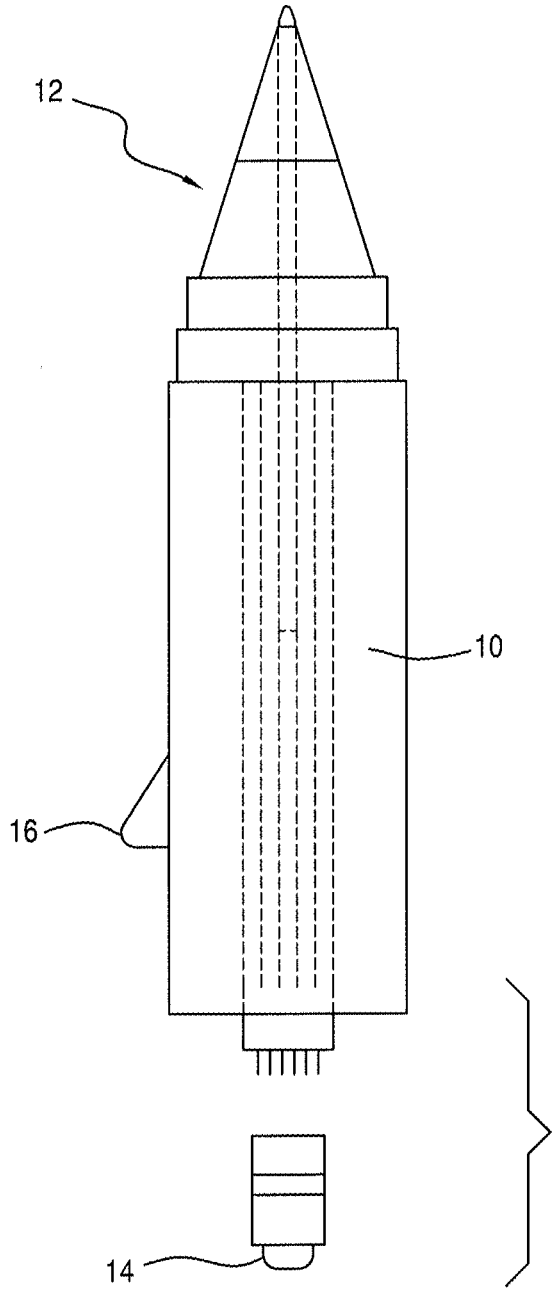
FIG. 2 is a schematic illustration of a single element showing the disposition of a writing point tubular storage of writing material and an eraser positioned on an opposite end of the pen.

As illustrated in FIGS. 2 and 3 a pen 10 includes a tip portion 12 and an eraser 14 for use when the pen 10 is used in its pencil configuration. The pen 10 also includes a member for extending one of the writing tips such as a clip like member 16 that is used to fasten a single color pen, pencil or correction stick in place after rotation of the pen with respect to the pen body to bring a chosen color into its serviceable position.

A second embodiment is illustrated in FIGS. 3 and 4 includes a plurality of cylindrical sub-assemblies as for example two sub-assemblies 101 and 102 and wherein a multi-color pen, pencil and eraser are disposed in a multi-unit body. For example, the pen 100 includes first and second writing points 103 and 103' that includes two color portions as for example blue and red and that include a recessed area 104 for gripping the pen with an individual's fingers. As shown in FIG. 3, a cover 106 includes a digital clock 108. The pen 100 includes a first sub-assembly 101 as for example for writing with blue ink and a second sub-assembly 102. It is also contemplated that one of the sub-assemblies may include correction fluid.

Figure 5:
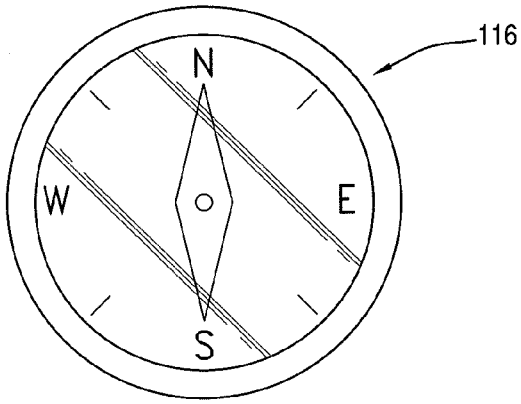
FIG. 5 is a top or plane view of a compass of the type disposed at the top of the pen cover.

The pen 100 also includes a cylindrical spacer 110 that covers the second writing portion 103 and an eraser 107 from portion 109. A removable second cover 113 covers the writing portion 111. A cover 113 sealingly closes the writing elements and also includes a digital temperature indicator 112 and rotatably mounted pocket clip 114 that includes a short ruler or straight edge and knife blade 117 and is rotatable about a common point 121. Finally, the cover 113 includes a compass 116 at the top of the cover 113. A more detailed drawing of the compass is shown in FIG. 5.

Figure 6:
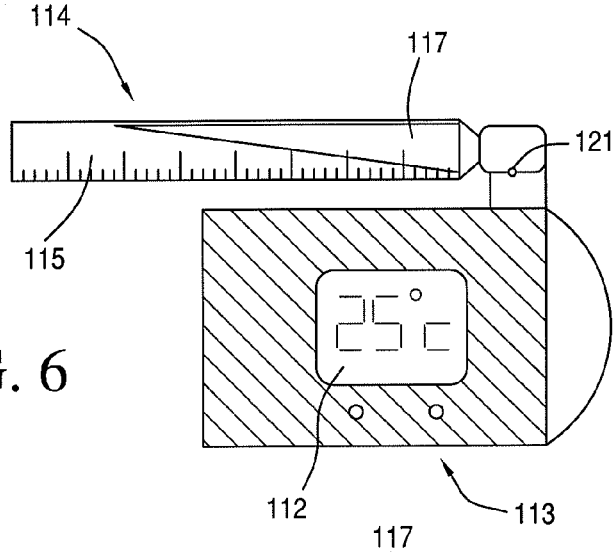
FIG. 6 is a side elevational view of a pen cover having a rotatable pocket clip with ruler and letter opener and showing a temperature display.
Figure 7:
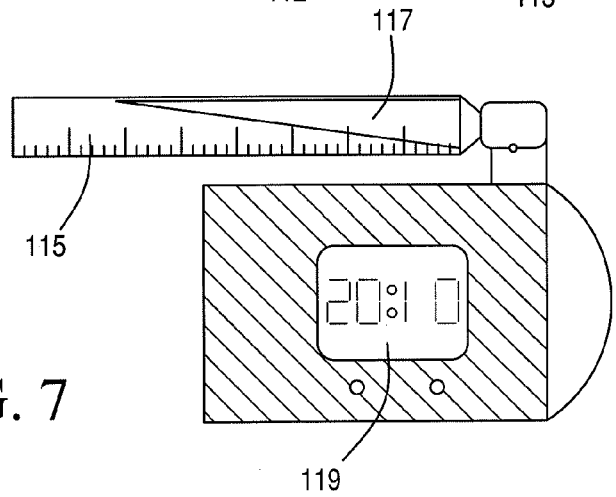
FIG. 7 is a side elevational view of a pen cover having a rotatable pocket clip with a ruler and letter opener and showing a time display.
Figure 8:
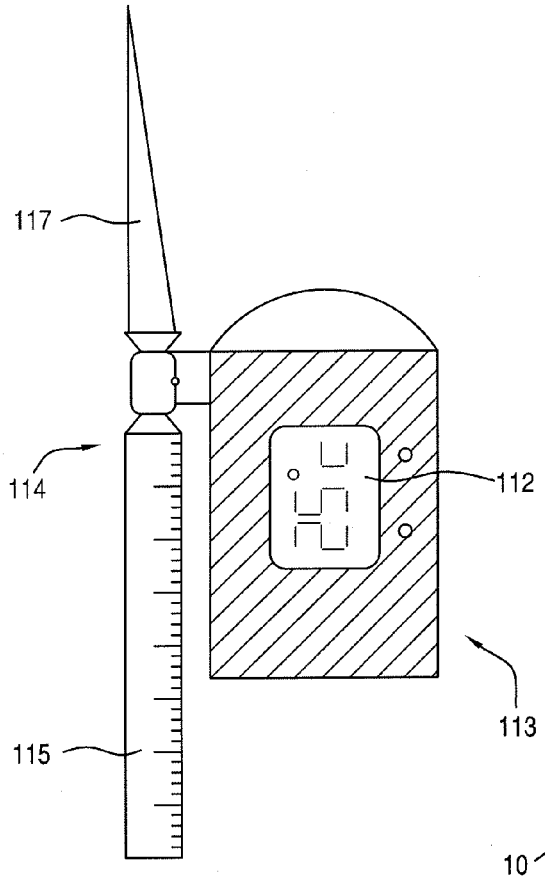
FIG. 8 is schematic illustration illustrating the separation of the ruler and the letter opener.

FIG. 6 shows the second cover 113 with the digital thermometer 112, pocket clip 114 with a short ruler 115 with indicators of length, and knife or a letter opener 117, while FIG. 7 shows the second cover 113 with a digital clock 119 in place of the digital thermometer 112. FIG. 8 is a further illustration of the second cover 113, but shows the knife 117 rotated about the center pivot or common point 121 away from the pocket clip 114. The knife 117 also serves as a letter opener.

Figure 9:
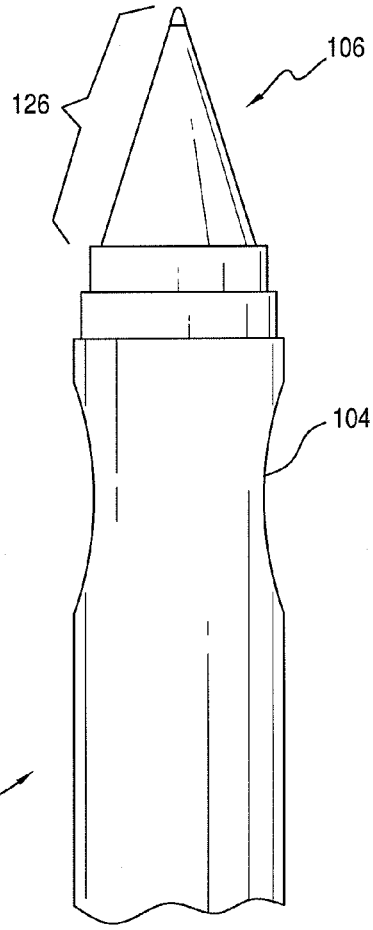
FIG. 9 is a side elevational view illustrating a taper in a pen holder for comfort in writing fixed to said fixed disc.
Figure 10:
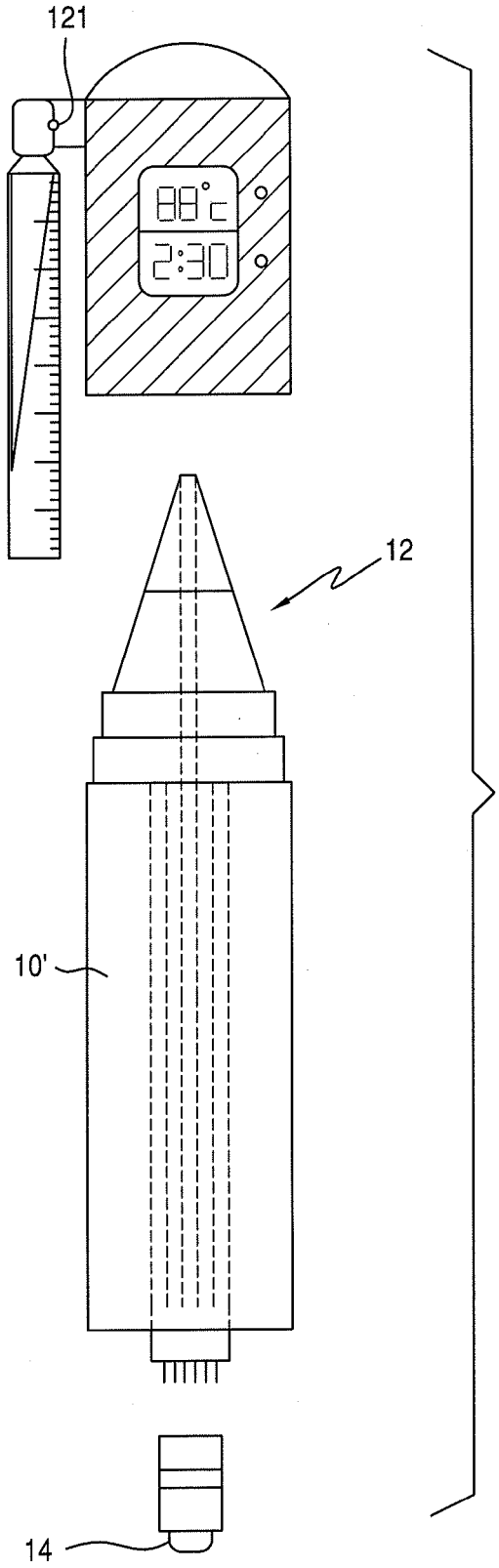
FIG. 10 illustrates a hollow tube with a tapered end in accordance with one embodiment of the invention.

Finally, FIG. 9 illustrates a pencil portion of the pen 10 with reduced area 104 and FIG. 10 illustrates a hollow tube 10' with a tapered end and a single readout that includes time and temperature.

While the invention has been described in connection with its preferred embodiments it should be recognized that changes and modifications may be made therein without departing from the scope of the appended claims.

What is claimed is:

1. A multi-color pen with a plurality of useful implements comprising:

a longitudinal extending pen body including two separable cylindrical elements each with opposite ends and wherein said cylindrical elements are aligned along a common axis;

a first writing element in a first selected color disposed in and extending out of one end of a first of said two separable cylindrical elements;

a second and a third writing element disposed in opposite ends of said second of said two separable cylindrical elements and wherein each of said second and third writing elements are of different colors that are different than the color of said first writing element;

a hollow connecting member for connecting said separable cylindrical elements together along the common axis to form said pen body having a first portion and a generally common diameter;

a first pen cover having an open end and a closed end constructed and dimensioned to cover and seal said first writing element and including a rotatable pocket clip extending downwardly along a first portion of said pen body and rotatable at one end thereof about an axis that is perpendicular to said common axis;

said rotatable pocket clip includes a ruler having a straight edge and graduations of length along said straight edge and a letter opener with a sharp edge separate from said straight edge;

a compass disposed on said closed end of said first cover and a digital readout for a temperature disposed in a side of said first cover;

a second pen cover having an open end and a closed end constructed and dimensioned to cover and seal one of said second or third writing elements; and a digital readout for a digital time disposed in said second cover.

* * * * *